United States Patent [19]

Sano et al.

[11] Patent Number: 4,847,176

[45] Date of Patent: Jul. 11, 1989

[54] BINDER-TYPE CARRIER

[75] Inventors: Eiichi Sano, Takatsuki; Junji Ohtani, Osaka; Toshitaro Kohri, Higashiosaka, all of Japan

[73] Assignee: Minolta Camera Kabushiki Kaisha, Osaka, Japan

[21] Appl. No.: 71,089

[22] Filed: Jul. 8, 1987

[30] Foreign Application Priority Data

Jul. 10, 1986 [JP] Japan ..... 61-163147

[51] Int. Cl.[4] ..... G03G 9/10

[52] U.S. Cl. ..... 430/106.6; 430/108; 428/407

[58] Field of Search ..... 430/106.6, 108

[56] References Cited

U.S. PATENT DOCUMENTS

| | | | |
|---|---|---|---|
| Re. 31,072 | 11/1982 | Jadwin et al. | 430/99 |
| 3,533,835 | 10/1970 | Hagenbach et al. . | |
| 3,669,885 | 6/1972 | Wright et al. . | |
| 3,720,617 | 3/1973 | Chatterji et al. . | |
| 3,795,618 | 5/1974 | Kasper . | |
| 3,840,464 | 10/1974 | Van Engeland et al. . | |
| 3,873,356 | 3/1975 | Queener et al. . | |
| 3,898,170 | 8/1975 | Kasper . | |
| 3,916,065 | 10/1975 | Moriconi | 428/403 |
| 4,013,573 | 3/1977 | Leikhim et al. . | |
| 4,062,693 | 12/1977 | Berger . | |
| 4,493,855 | 1/1985 | Sachdev et al. . | |
| 4,517,268 | 5/1985 | Gruber et al. | 430/39 |
| 4,518,673 | 5/1985 | Noguchi et al. . | |
| 4,555,466 | 11/1985 | Okada | 430/106.6 |
| 4,600,675 | 7/1986 | Iwasa et al. | 430/108 X |
| 4,609,603 | 9/1986 | Knapp | 430/39 |
| 4,672,016 | 6/1987 | Isoda et al. | 430/108 |

FOREIGN PATENT DOCUMENTS

| | | | |
|---|---|---|---|
| 59-37553 | 4/1973 | Japan . | |
| 60-170865 | 2/1974 | Japan . | |
| 59-201064 | 9/1974 | Japan . | |
| 60-147750 | 6/1975 | Japan . | |
| 60-107038 | 7/1977 | Japan . | |
| 60-50543 | 11/1979 | Japan . | |
| 57-122449 | 7/1982 | Japan | 430/108 |
| 57-190957 | 11/1982 | Japan | 430/108 |
| 59-223458 | 12/1984 | Japan | 430/108 |
| 59-69762 | 2/1986 | Japan . | |
| 59-200262 | 3/1988 | Japan . | |

OTHER PUBLICATIONS

F. Lions, K. V. Martin, *Journal of the American Chemical Society,* 1957, 79 2733–1738.

*Primary Examiner*—Roland E. Martin

*Attorney, Agent, or Firm*—Burns, Doane, Swecker & Mathis

[57] ABSTRACT

The invention relates to binder type carrier comprising at least magnetic particles and binder resin having an acid value of 50 mg KOH/g or less and a hydroxyl value of 50 mg KOH/g or less, in which a product of the acid value by the hydroxyl value is within the range of from 1 to 600, which gives a high specific volume resistance of equal or more than $10^{13}$ Ωcm, and an excellent humidity resistance.

4 Claims, No Drawings

BINDER-TYPE CARRIER

BACKGROUND OF THE INVENTION

This invention relates to binder-type carriers, more particularly, to binder-type carriers suitable for a developing method of electrostatic latent images, in which developers consisting of toners and magnetic carriers are carried to a developing region by a rotating developing sleeve with a magnet in the inside and the electrostatic latent images on the surface of a photosensitive member are developed in the developing region.

Conventionally, a magnetic brush of magnetic developers contacted with a photosensitive member which functions as a carrier of electrostatic latent images is formed by magnetic forces on the surface of a developing sleeve to develop the electrostatic latent images on the photosensitive member, in which mixtures of magnetic carriers such as iron particles of about 100–200μm in a mean particle size with insulating toners of about 10–20μm in a mean particle size were used as developers. The developers, although, bring about such a trouble as white lines in developed images, because an ear of the brush is hard on account of strong suction force between the carrier particles and the carriér particles aggregate in the form of chains or fins on the surface of the developing sleeve. When the content of toner decreases by continuous use of the developer, the other troubles sometime occur such as the disorder of the electrostatic latent images, the deficit of the developed images and the adherence of the carriers to a part of the electrostatic latent images on the photosensitive member and the like, because the charge of the electrostatic latent images on the photosensitive member tends to run away through the low specific resistant carriers of $10^{6}\Omega$.cm or less. And that, there was a defect that the hard carriers adhered to the electrostatic latent images on the photosensitive member give damage to the surface of the photosensitive member when they are cleaned by, for example, a blade cleaner.

On the other hand, in order to answer to the above problems caused of the carriers consisting only of magnetic materials, the U.S. Pat. No. 4284702 made public binder-type carriers of 5–30μm in a mean particle size, in which magnetic fine materials are dispersed in such an insulating material as resin, etc. and they have been put in practical use. The above binder-type carriers have an advantage that excellent images free from white lines are formed because of low magnetization of about 1000 gauss in the magnetic field generated in a general developing machine to be able to produce a soft ear. But, the binder-type carriers of this kind have a defect of an increase in cost of a developing machine for needness of a high torque-supplying motor as well as a weak point of heat of a developing sleeve in application thereof to recently required high-speed development.

A generally desired developing machine has a system that a magnetic brush of developer formed by rotating a magnet inside the developing sleeve transports developer on a developing sleeve. But a change of magnetic pole brought about by a rotating, especially at low speed, magnet results in surface irregularity, which tends to increase as the developing speed (that is, the movement speed of an electrostatic latent image carrier) increases. It is necessary in order to prevent the above problem that a magnet is made rotate at as high speed as possible. The rotating speed of the magnet, which is in general set within the range of 1000–2500 r.p.m., should be higher than the moving speed of the electrostatic latent image carrier. So, the higher the developing speed is, the more whirling electrical current increases. That results in heat of the developing sleeve to higher temperature, besides the increment of a rotating driving load and the requirement of a high torque supplying motor. Further, some electrophotographic reproduction machines on sale employ developing machines which are systematized not only with a high speed rotating magnet but also with a assistantly rotating developing sleeve. But the machines cannot prevent the above mentioned problems.

A method comprising rotating only a developing sleeve with a magnet fixed (hereinafter referred to as "the developing sleeve rotating system") does not generate the problem caused by a rotating magnet contrary to the magnet rotating method. Accordingly, there may be a proposed attempt to apply binder type carriers for the magnet rotating system to the developing sleeve rotating system in order to solve the defect accompanied by the rotation of a magnet and simultaneously to provide good images free from white lines caused by the aggregation of magnetic materials. But, even if the binder type carriers are merely applied to the developing sleeve rotating system, the obstacle in practical use is found that a great number of carriers adhere to a part of non-image on the surface of an electrostatic latent image carrier and so the above proposed attempt have not been put to practical use.

The higher the ratio of magnetic particles to binder resin in binder type carriers becomes, the lower the electrical resistance of carriers becomes. Especially in case of binder type carriers with small particles size, the hygroscopicity becomes higher causing the above problem to become more remarkable.

SUMMARY OF THE INVENTION

The object of the invention is to solve the above problems in the magnetic carriers used in the developing method of electrostatic latent images on an electrostatic latent image carrier which comprises sending magnetic developers consisting of toners and magnetic carriers by either rotating a developing sleeve with a magnet in the inside or rotating both the magnet and the developing sleeve, and to provide binder type carriers which do not aggregate and can form a soft brush to provide good images free from white lines.

Another object of the invention is to provide carriers excellent in humidity resistance.

Another technical subject of the invention is to provide sharp images given a suitable edge effect and to prevent from adhering of carriers to parts of images on the surface of an electric latent image carrier which is caused by the injection of charges from the developing sleeve.

Another technical subject of the invention is to prevent the charge storage caused by triboelectrification to stabilize the chargeability of toners and to prevent adhering of carriers to parts of non-images on the surface of an electrostatic latent image carrier.

Another technical subject of the invention is to prevent the deterioration of carriers to make the life of carriers long.

DETAILED DESCRIPTION OF THE INVENTION

The present invention relates to binder type carriers comprising at least magnetic particles and binder resin having an acid value of 50 mg KOH/g or less and a hydroxyl value of 50 mg KOH/g or less, in which a product of the acid value by the hydroxyl value is within the range of from 1 to 600.

Examples of the binder resin applicable in the invention are: the acrylic resin containing polar group such as carboxyl group, hydroxyl group, glycidyl group, amino group and the like, for example, a copolymer of a monomer such as methacrylic acid, acrylic acid, maleic acid, itaconic acid, etc. a hydroxyl containing monomer such as hydroxyl- polypropylene-monomethacrylate, polyethylene glycol-monomethacrylate, etc., an amino group containing monomer such as dimethylaminoethyl methacrylate, etc., or glycidyl methacrylate and the like with lower alkyl acrylate and/or styrene; polyester resin, for example, a condensate of polyol such as ethylene glycol, triethylene glycol, 1,2-propylene glycol, 1,4-butanediol, etc., with dicarboxylic acid such as malec acid, itaconic acid, malonic acid, etc.; and thermoplastics such as epoxy resin, etc.; a mixture of the above resin, which may have different characteristics dependent on preparing conditions such as temperature, a kind of a catalyst, an amount of a catalyst, reactive time, addition of a chain transfer agent or a crosslinking agent.

The acid value (Av) and hydroxyl value (OHv) of the binder resin to be applied to carriers of the invention must be both 50 mg KOH/g or less.

Carriers composed of resin having Av or OHv of more than 50 mg KOH/g may give a high specific volume resistance just after preparation of the carriers, but are difficult to provide good images free from fogs for a long time because of lack of both humidity resistance and long stable supply of charge to toners.

To apply binder resin to carriers of the present invention, the product of Av by OHv (Av×OHv) of the resin is within the range of between 1 and 600, preferably within the range of between 1 and 400. But, if Av or OHv is within the range of between more than 0 and less than 1, Av or OHv is regard as 1 to caluculate Av×OHv. Carriers, if composed of resin with more than 600 of Av×OHv, lack humidity resistance and have aforementioned defects.

An acid value of the invention can be measured according to the conventional method, and expressed as mg number of potassium hydroxide needed to neutralize acid groups of 1 g of resin dissolved in suitable solvent.

A hydroxyl value of resin can be also measured according to the conventional method and expressed as mg number of potassium hydroxide needed to neutralize acetic acid which is liberated by the hydrolysis of acetylated product which is prepared by the acetylation of the resin(lg) with acetic anhydride.

The binder type carriers composed of specified resin in the invention are hard to absorb moisture on the surface and more hydrophobic than conventional carriers.

The carriers of the invention have high electrical resistance because surface conductivity which results in decrease of specific volume resistance is restrained.

The carriers of the invention can provide good images in good quality because of good humidity resistance and long stable supply of charge to toners even under high temperature and high humidity.

Concrete examples of ferrite, which are shown in U.S. Pat. No.4473483, have the general formula;

$$M_{\frac{1-x}{1+x}(1-y)}\,Fe_{\frac{2x}{1+x}(1-y)}\,O_y$$

wherein M is an atom selected from the group consisting of Ni, Co, Mg, Cu, Zn and Cd; x is within the range of between 0.5 and 1.0 and y is within the range of between 0.1 and 0.571.

Ferrite of the invention in addition of the above ferrite includes metals containing ferromagnetic metals such as magnetite shown by $FeO.Fe_2O_3$,iron, Nickel and Cobalt, etc., alloys of the metals and compounds thereof.

The magnetic fine particles are generally mixed with binder resin at the ratio of 200–900 parts by weight to 100 parts by weight of the binder resin.

Enough magnetization cannot be achieved in the beforementioned magnetic field if the magnetic fine particles are less than 200 parts by weight, and carriers fragile if the magnetic fine particles are more than 900 parts by weight.

The preferred carriers of the invention from the magnetic viewpoint have $1000 \leqq Bm \leqq 7000$, preferably $2000 \leqq Bm \leqq 3000$ as magnetic flux density of the carriers (Bm) (gauss). An ear of a magnetic brush gets too hard if magnetic flux density is more than 7000 gauss and enough magnetization cannot be achieved in the magnetic field if magnetic flux density is less than 1000 gauss.

It is an advantage of the invention that specific volume resistance of carriers can be kept high, that is, equal or more than $10^{13\,0}\Omega$.cm even if much magnetic fine particles such as more than 500 parts by weight are dispersed in binder resin. The advantage has heretofore been unachievable by the prior art because carriers resulted in too low specific volume resistance to practically use them.

Before the present invention, carriers containing about 200–about 900 parts by weight on the basis of 100 parts by weight of binder resin must be particularly treated to make electrical resistance high before they are put to use. This has been considered applicable to any resin. It is the reason that only low electrical resistance carriers had been obtained, because in the conventional carriers the electrical resistance of the used magnetic particles itself is exhibited due to so insufficient dispersion of magnetic particles that the particles are not individually separated or high hygroscopicity results in the increment of the surface conductivity.

It had not been predicted that such high electrical resistant carriers as present invention can be prepared by the selection of resin, the selection of reactive conditions or the selection of resin with specified natures (physical properties).

Carriers of the invention can be applied to copying machines furnished with high rotation developing sleeves to protect the adherence of the carriers to photosensitive members and carrier development to images and give good images free from deficits.

If specific volume resistance of carriers is lower such as $10^{8-1012}\Omega$. cm, the specific volume resistance of the developers also decrease. In such case, the latter resistance can be made higher by increasing the content of the toner in the developer(generally 5 wt. % or more), but this manner is not preferred, because it does not give a suitable edge-effect and much carriers are inevitably adhered to images by injected charges when the content of toner in the developer decreases as the developing progresses.

The carriers of the invention can be prepared by mixing binder resins with magnetic particles sufficiently at the specified mixing ratio to be heated and by grinding the obtained mixture after cooling and classifying the resultant.

In the preferred embodiment of he invention, the mean particle size of the carriers are adjusted to the range of between 15–100μm in weight average particle size, in order to prevent the aggregation of carriers and the adherence thereof to an electostatic latent image carrier more perfectly. The carriers tend to aggregate and adhere to the electrostatic latent image carrier and that result in the deterioration of the carrier flowability, if the mean particle size of the carriers is less than 15 μm. Brushing surface irregularity and the like occur as can be similarly seen in iron particle carriers and clean images cannot be formed, if the mean particle size of the carriers is more than 100 μm. Further, the carriers of the invention may be given;

(a) the surface treatment by fine particles such as silica, titanium oxide, aluminum oxide, etc.

(b) the heat treatment in order to modify the surface of the carriers after usual grinding, classifying and size-arranging of the particles.

This invention will now be explained with reference to examples hereunder.

EXAMPLE 1

Synthesis of binder resin

| | parts by weight |
|---|---|
| styrene | 100 |
| buthyl methacrylate | 90 |
| methacrylic acid | 0.4 |
| 2-hydroxylethyl methacrylate | 0.4 |
| azobisisobutyronitrile | 3.4 |

The mixture of the above composition was dissolved in xylene of 200 parts by weight and then pre-polymerized in the nitrogen current at 100° C. for 20 minutes. Thereafter, the reactant was cooled to 70° C. and polymelized for 4 hours at 70° C. The copolymerized binder resin had 1.4 mg KOH/g of Av, 0.9 mg KOH/g of OHv and 1.4 of Av×OHv.

Preparation of binder type carriers

The composition below was heated, kneaded and cooled, ground and classified to prepare carrier A of 60 μm in mean particle size.

[carrier composition]

| | parts by weight |
|---|---|
| The above copolymerized binder resin | 100 |
| Zn-ferrite (max magnetization: 72 emu/g Hc:110 specific volume resistance: $3 \times 10^8$ | 500 |

The resulting copolymerized resin was put to use to prepare carriers B, C, D, E, F with mean particle size of 60 μm at the above carrier composition.

EXAMPLE 7

The reactor equipped with a stirrer was charged with 500 parts by weight of polyoxypropylene (2.2)-2,2-bis(4-hydroxyphenyl) propane and 250 parts by weight of terephthalic acid, set in a mantle heater, converted to the nitrogen atmosphere and heated up, and then dibutyltin oxide of 0.05 g was added to the contents to start the reaction.

Further, 63 g of 1,2,4-carboxy-benzene was added to the above contents to prepare polyester resin which had characteristics of 120° C of softening temperature, 58° C. of glass transition temperature, 22 mg KOH/g of Av, 27 mg KOH/g of OHv and 594 mg of (Av×OHv). The polyester resin was put to use to prepare carrier G of 60 μm in mean particle size at the above carrier composition.

Comparative Examples 1 and 2

Copolymerized binder resin was prepared in a similar way as Example 1 except that an amount of methacrylic acid and an amount of 2-hydroxylethyl methacrylate were varied as shown in 8 and 9 of Table 1 and Av and OHv of the resin were shown in Table 1. The resulting copolymerized resin was put to use to prepare carriers H, I of 60 μm in mean particle size at the above carrier composition.

Comparative Example 3

Polyester resin which had characteristics of 120° C. of softening temperature, 58° C. of glass transition temperature, 18 mg KOH/g of Av, 40 mg KOH/g of OHv was prepared in a similar way as Example 7 except that 700 parts by weight of polyoxypropylene (2,2)-2,2-bis(4-hydroxylphenyl)propane and 97.2 parts by weight of terephthalic acid were used. The resulting polyester resin was put to use to prepare carrier J of 60 μm in mean particle size at the above carrier composition.

COMPARATIVE EXAMPLE 4

Copolymerized binder resin was prepared nn a similar way as Example 1 except that neither methacrylic acid nor 2-hydroxylethyl methacrylate was added. The resulting resin was put to use to prepare carrier K of 60 μm in mean particle size at the above carrier composition.

COMPARATIVE EXAMPLES 5 and 6

Copolymerized binder resin was prepared in a similar way as Example 1 except that either an amount of methacrylic acid or an amount of 2-hydroxylethyl methacrylate was varried as shown in xii and xiii of Table 1. Av and OHv of the resin were shown in Table 1. The resulting copolymerized resin was put to use to prepare carrier L, M of 60 μm in mean particle size at the above carrier composition.

EXAMPLE 8

Specific volume resistance of carriers

The specific volume resistance of the carriers A–M was measured to show the results in Table 1.

The specific volume resistance was measured as the method shown below.

A sample of 1 mm in thickness and 50 mm in diameter was put on a round electrode made of metal and then an electrode of 875.4 g in weight and 20 mm in diameter and a guarded electrode of 38 mm in internal diameter and 42 mm in external diameter were put on the sample to be supplied with 500 V of direct voltage. The value of resistance was read after 1 minute to calculate the specific volume resistance of the sample. The environment of the measurement was 25±1° C. of temperature and 55 ±5% of relative himidity and the measurement was repeated five times to obtain the mean value.

As shown in Table 1, the more (Av×OHv) increases, the lower specific volume resistance becomes except Comparative Examples 5 and 6 in the case of (Av×OHv) ×100.

Charge amount of toners and Evaluation of image quality

Preparation of Toners (i) (−) chargeable toners

| | parts by weight |
|---|---|
| polyester resin (130° C. of softening temperature, 60° C. of glass transition temperature) | 100 |
| carbon black (MA #8 produced by Mitsubishi Kasei Co.) | 5 |

(ii) (+) chargeable toners

| | parts by weight |
|---|---|
| styrene n-butyl methacrylate resin (130° C. of softening temperature; 60° C. of glass transition temperature) | 100 |
| Carbon black (MA #8 produced by Mitsubishi Kasei Co.) | 5 |
| nigrosine dye (Bontron N-01 produced by Orient Chemical Co.) | 3 |

The above materials were mixed sufficiently with ball mills and then kneaded on three rolls heated at 140° C. the kneaded materials were stood to be cooled, ground roughly with the feather mill, ground finely with the jet mill, and then air-classified to obtain fine particles of 13 μm in mean particle size. The respective polar toners are hereinafter referred to as toner A ((−) chargeable toners) and toner B ((+) chargeable toners).

Preparation of Developers

Toner A or toner B was mixed with the carriers A–M at the ratio of 10 wt. % for 10 minutes to prepare developers.

Evaluation of chargeability and image quality

The developers were put to use to develop positively-charged electrostatic charge images according to the magnetic brush developing method with the developing machine equipped with a (+) chargeable Se-type photosensitive member and a heat-fixing roll coated with teflon(registered trade mark). The development was continuously repeated 60000 times.

The results of the charge amount were shown as charge amount A.

Adherence of carriers to the part of image were examined by observing whether solid images, which formed with EP-470 Z (Minolta Camera K.K.) under 23° C. of temperature and 45° C. of relative humidity, contain carriers.

The results were shown in the item of image quality of Table 1.The symbols of evaluation of the image quality mean;

VG: no developed carriers can be seen

G: carriers may be developed in case toner concentration becomes very low.

P: only a few carriers are developed.

In Examples 1–7, the image quality was excellent and had no carrier fogs after the copying resistant test of 60000 times as well as at the initial stage of the test. No carriers were seen adhered to the photosensitive members. The image quality was particularly excellent when (Av×OHv) is within the range of between 2 or more and 400 or less.

To the contrary, the carriers in Comparative Example showed unstable concentration of images and resulted in images with many fogs. And that the carriers were developed at the developing area of toners as expected from the values of specific volume resistance and so the resulting images were not good.

Toner B was examined similarly. The carrier in Examples 1–7 provided images of good quality free from fogs etc. from the initial stage and did not adhere to photoslensitive members. The image quality was particularly excellent within the range of between 2 or more and 400 or less of (Av×OHv).

The image quality in Comparative Examples 1–6 was inferior, similarly to toner A.

But, in this case of toner B, the system for the test of copying resistance was as same as that in the case of toner A except that a (−) chargeable laminated-type organic photosensitive member was applied and negatively-charged electrostatic charge images were developed and transfered.

himidity resistance

Developers containing toner A or toner B was prepared. A charge amount of toner after mixing of the developer for 10 minutes was compared with that of toner after storage of the developer under high temperature and high himidity (35° C. of temperature; 85% of relative humidity) for 24 hours.

The environmental resistance was examined by observing the decrease of the charge amount. The results were shown in Table 1.

As shown in Table 1, the more (Av×OHv) increases, the worse environmental resistance. is, which is remarkable when (Av×OHv) exceeds 600. The environmental resistance is good when (Av×OHv) is 400 or less.

And, if either Av or OHv exceeds 50,the deterioration of the environmental resistance is remarkable. If (Av×OHv) is less than 2, the charge amount is comparatively low and so resin with 2 or more is preferable.

TABLE 1

| No. | Example/ Comparative Example | resin | methacrylic acid (parts by weight) | 2-HM*1 (parts by weight) | Av | OHv | Av × OHv | carrier | ρ*2 (Ω · cm) | charge*3 amount A (μc/g) | charge*4 amount A (μc/g) (HH) | charge*5 amount B (μc/g) | charge*6 amount B (μc/g) (HH) | image quality |
|---|---|---|---|---|---|---|---|---|---|---|---|---|---|---|
| i | Example 1 | styren, acrylic | 0.4 | 0.4 | 1.4 | 0.9 | 1.4 | A | $2.9 \times 10^{13}$ | −10.2 | −10.2 | 10.8 | 10.8 | G |
| ii | Example 2 | styren, acrylic | 0.6 | 0.6 | 2.0 | 1.4 | 2.8 | B | $5.0 \times 10^{13}$ | −10.6 | −10.5 | 11.1 | 11.0 | VG |
| iii | Example 3 | styren, acrylic | 3.8 | 3.0 | 12.6 | 6.6 | 83.2 | C | $6.8 \times 10^{13}$ | −11.2 | −11.0 | 12.1 | 11.9 | VG |
| iv | Example 4 | styren, acrylic | 7.0 | 4.0 | 22.7 | 8.6 | 194.4 | D | $4.0 \times 10^{13}$ | −12.0 | −11.8 | 12.8 | 12.6 | VG |
| v | Example 5 | styren, acrylic | 7.0 | 6.8 | 22.4 | 14.4 | 322.6 | E | $3.2 \times 10^{13}$ | −12.4 | −12.1 | 13.2 | 13.0 | VG |
| vi | Example 6 | styren, acrylic | 8.6 | 10.5 | 26.8 | 21.6 | 578.9 | F | $2.1 \times 10^{13}$ | −13.0 | −12.7 | 13.9 | 13.6 | G |
| vii | Example 7 | polyester | — | — | 22.0 | 27.0 | 594.0 | G | $6.0 \times 10^{13}$ | −13.0 | −12.6 | 13.7 | 13.4 | G |
| viii | Comparative Example 1 | styren, acrylic | 8.6 | 11.2 | 26.7 | 23.0 | 614.1 | H | $4.8 \times 10^{11}$ | −13.6 | −13.0 | 14.5 | 13.9 | P |
| ix | Comparative Example 2 | styren, acrylic | 9.5 | 14.0 | 29.0 | 28.2 | 817.8 | I | $2.1 \times 10^{11}$ | −14.8 | −13.6 | 16.0 | 14.8 | P |
| x | Comparative Example 3 | polyester | — | — | 18.0 | 40.0 | 720.0 | J | $3.1 \times 10^{11}$ | −13.6 | −13.1 | 14.2 | 13.2 | P |
| xi | Comparative Example 4 | styren, acrylic | — | — | — | — | — | K | $8.1 \times 10^{11}$ | −6.3 | −6.3 | 5.8 | 5.8 | P |
| xii | Comparative Example 5 | styren, acrylic | 20.0 | — | 63.0 | — | — | L | $5.2 \times 10^{11}$ | −12.3 | −11.6 | 10.5 | 9.7 | P |
| xiii | Comparative Example 6 | styren, acrylic | — | 30.0 | — | 59.7 | — | M | $5.0 \times 10^{11}$ | −11.1 | −10.3 | 11.6 | 10.7 | P |

*1: 2-hydroxyl methacrylate;
*2: specific volume resistance;
*3: charge amount of toner A;
*4: charge amount of toner A after kept high temperature and high humidity (35° C., 85%) for 24 hours
*5: charge amount of toner B
*6: charge amount of toner B after kept high temperature and high humidity (35° C., 85%) for 24 hours

What is claimed is:

1. Binder type carriers comprising at least magnetic particles and binder resin having an acid value of 50 mg KOH/g or less and a hydroxyl value of 50 mg KOH/g or less, in which a product of the acid value by the hydroxyl value is within the range of from 1 to 600, said magnetic particles being from 200 to 900 parts by weight to 100 parts by weight of said binder resin, said binder type carriers having a mean particle size of from 15 to 100 μm and having a magnetic flux density of $1000 \leqq Bm \leqq 7000$ 2. Binder type carriers of the claim 1, in which the magnetic particles have a specific volume resistance of $10^{7}\Omega$. cm or more.

3. Binder type carriers of the claim 1, in which the binder resin is selected from the group consisting of acrylic resin, acrylic-styrene resin, polyester resin, and epoxy resin.

4. Binder type carriers of the claim 1, having a magnetic flux density of $2000 \leqq B_m \leqq 3000$.

* * * * *